United States Patent [19]

Krehbiel et al.

[11] 4,021,832

[45] May 3, 1977

[54] PHOTOCELL CONTROL DEVICE FOR A PHOTOGRAPHIC FILM PROCESSOR

[75] Inventors: Vivian D. Krehbiel; Carl E. Cord, both of Wichita, Kans.

[73] Assignee: Kreonite, Inc., Wichita, Kans.

[22] Filed: Aug. 5, 1974

[21] Appl. No.: 494,875

[52] U.S. Cl. ..... 354/298; 137/93; 250/560; 361/176

[51] Int. Cl.[2] ..... G03D 13/00

[58] Field of Search ..... 137/93; 250/209, 560; 354/297, 298, 299, 324; 134/64 P; 317/124, 127

[56] References Cited

UNITED STATES PATENTS

| | | | |
|---|---|---|---|
| 2,913,974 | 11/1959 | Sabel et al. | 354/322 |
| 3,246,357 | 4/1966 | Ammons | 15/230.11 |
| 3,382,790 | 5/1968 | Matheson | 134/64 P |
| 3,472,143 | 10/1969 | Hixon et al. | 354/298 |
| 3,483,430 | 12/1969 | Nuckolls et al. | 250/209 X |
| 3,763,758 | 10/1973 | Manack et al. | 354/298 X |
| 3,787,689 | 1/1974 | Fidelman | 354/298 X |
| 3,822,723 | 7/1974 | Crowell et al. | 354/297 X |

FOREIGN PATENTS OR APPLICATIONS 988,332 4/1965 United Kingdom

OTHER PUBLICATIONS

B412,516, Jan. 1975, Kinoshita et al., 354/298.

*Primary Examiner*—Fred L. Braun
*Attorney, Agent, or Firm*—John H. Widdowson

[57] ABSTRACT

A processor having infrared sensed chemical replenishing system for processing photosensitive material. The processor includes a replenishing circuitry having a power supply; a pulsed infrared sensor electrically connected to the power supply for measuring the width of photosensitive materials; a pulse generator circuit for generating a pulse width and repetition rate to the infrared sensor means; and a summing circuit for producing a summation of all latched input elements transmitted from the sensor means. The replenishing circuit also includes a replenishment calibration timing circuit for producing a replenishment command signal following a successive time interval equal to the time required for the processor drive to turn one revolution, and a control circuitry for controlling the chemical flow of the replenishment system. The processor includes a transport system including successive pairs of driven rollers, one of the rollers of each pair having a resilient stocking covering which contacts the emulsion side of the film.

16 Claims, 8 Drawing Figures

PHOTOCELL CONTROL DEVICE FOR A PHOTOGRAPHIC FILM PROCESSOR

BACKGROUND OF THE INVENTION

1. Field of the Invention

This invention relates to a method and apparatus for processing photosensitive material. More specifically, this invention provides a method and apparatus for processing photosensitive material which utilizes pulsed infrared sensing replenishment system which senses photosensitive materials without producing undesirable photo exposure effects and an improved transport system having successive pairs of novel, driven roller. Photo exposure is avoided by utilization of very brief pulses of infrared energy.

2. Description of the Prior Art

Conventional photographic film/print processors include among various other systems replenishment and transport systems. Replenishment systems currently have metering devices which automatically replenish a pre-selected quantity of chemical replenisher to the chemical tanks when paper is fed into the processor. The most popular metering devices employed today are micro sensing switches which are located on the feed table; the number of switches needed vary in accordance with the width of the processor. As paper is fed over the feed table and into the feed slot, it depresses at least one of the sensing switches in order for its width to be determined. At least one of the sensing switches has to be depressed for ensuring proper replenishing of chemicals by a replenishment timer printed circuit board which regulates the replenishment action through a replenishment cabinet by the relayed impulses transmitted from the micro sensing switches and a revolution counter switch. The revolution counter switch detects the running length of paper as it passes through the processor, and the replenishment cabinet includes flowmeters and solenoids which allow the passage of replenishment chemicals upon reception of relayed impulses from the replenishment timer printed circuit board. This replenishment system is plagued with the fact that quite sensitive photographic materials can not be passed over the micro sensing switches because of the abrasive damage caused by the depressing. Also, this prior art replenishing system is inaccurate and demands a lot of the operator's time in operation.

Conventional transport systems have a complex problem in transporting a length of film, having a delicate emulsion layer, through the various stages of a developing process. One of the primary problems experienced in continuous movement processors is bromide drag. Most of the prior art today transport the film by driven rollers held against each other by spring action. As the film passes through the rollers, a squeegee action takes place causing the bromide salts to build up behind the rollers, creating what is known in the trade as "bromide drag". Another serious problem with solid rollers is the build up of silver and other deposits on the rollers which must be removed and cleaned periodically. Solid rollers require a complex spring tensioning arrangement holding one roller against the other to maintain the close tolerances that are necessary.

Another prior art method utilizes solid rollers in combination with woven plastic belts. This system has a streaking problem on the film, due to the belt pressure, and includes a complex apparatus to handle the distortion and stretch of the belts.

Therefore, what is needed and what has been invented is an improved process and photographic film processor for developing photographic material; the processor includes an improved replenishing system and an improved transport system which do not have the foregoing major deficiencies.

SUMMARY OF THE INVENTION

The present invention accomplishes its desired objects by broadly providing pulsed infrared sensing for the chemical replenishing system for a photographic film processor, or the like, having a power supply; an infrared sensing means including emitter means and sensing means electrically connected to power supply for measuring the width of sensitive photo materials without touching the same; a pulse generator circuit means which reduces the photo exposure due to the sensing pulse to a neglible level, this pulse generator circuit being electrically attached to the emitter means for generating a pulse width and repetition rate; a summing circuit means electrically connected to the sensor means for producing a summation of all latched input elements transmitted from the sensor means; a replenishment calibration timing circuit means electrically attached to the infrared sensing means and the summing circuit means for producing at least one replenishment command signal following at least one successive time interval which is equal to the time required for the processor drive to turn one revolution; and a control circuitry means in electrical communication with the summing circuit means and the timing circuit means for controlling the chemical flow of the replenishment system. The control circuitry means has a stop circuit and a start circuit. The start circuit responds to the sum of all latched input elements from the summing circuit and closes a relay which starts a replenishment calibration timer. The relay opens or closes a solenoid valve through which the replenishment chemicals flow. The stop circuit compares the sum of all latched input elements and the calibrated time integral of the replenishment calibration timer and when the sum is about equivalent to the time integral, the stop circuit opens the relay to close the solenoid.

The present invention also accomplishes its desired objects by broadly providing a process for developing film and a novel processor. The processor broadly comprises introducing sensitive photographic material into a processor's feed slot having infrared sensing means including emitter means and sensing means; measuring the width of the sensitive photo materials without touching same and without photo exposure by the infrared sensing means; generating a pulse width and repetition rate by a pulse generator circuit means; producing a summation of all latched input elements transmitted from the sensor means by a summing circuit means; producing at least one replenishment command signal by a replenishment calibration timing circuit following at least one successive time interval which is equal to the time required for the processor drive to turn one revolution; and controlling the chemical flow of the replenishment system by a control circuitry. The novel processor includes in addition to the aforementioned circuitry limitations, a feed module means; a chemical/wash module means; a dryer module means; and a transport means which utilizes a stocking covered roller. As the roller comes in contact with the film, the bromide salts formed on the surface are entrapped between the fibers of the stocking and carried through on the roller rather than squeegeed behind the rollers. Before the roller again comes in contact with the film, it is exposed to a bath of fresh solution which washes these reacted chemicals from the stocking. The stocking is slightly depressed as the roller comes in contact with the film, causing the fibers of the stocking to mildly scrub the emulsion surface of the film, removing the exhausted chemicals, thereby better agitating the processing solution. When there is no film passing between the rollers, the stocking self-cleans itself by the continuous squeezing action against its companion roller in a circulating bath of clean solution. This squeezing action also scrubs any build up of silver off the companion roller.

It is therefore an object of the present invention to provide an infrared sensing and measuring primarily applicable to photosensitive materials system.

It is another object of the present invention to provide a process for developing film and a photographic film processor having a novel replenishing system.

It is another object of the present invention to provide an infrared sensing replenishment system which is readily designed for fast, easy installation in existing processors.

It is therefore another object of the present invention to provide an improved film transport means that substantially reduces bromide drag streaking and scratching of the film emulsion.

Another object of the invention is to provide a combination infrared sensed replenishing system and transport system having self-cleaning rollers which scrub against themselves when no film is in the processor.

A further object of the present invention is a roller transport system which provides more active agitation of the chemistry on the film, thereby shortening the development time.

Still another object of the invention is to provide a roller type transport system without spring tensioning means on the rollers while maintaining even pressure across the rollers.

A further object of the invention is to provide a film roller which will wash itself in a slow moving solution of the exhausted chemicals collected from the film.

These, together with various ancillary objects and features which will become apparent as the following description proceeds are obtained by this novel infrared replenishing system, processor and transport system included within the processor, a preferred embodiment being shown in the accompanying drawings, by way of example only, wherein:

DETAILED DESCRIPTION OF THE INVENTION

Figure 1:
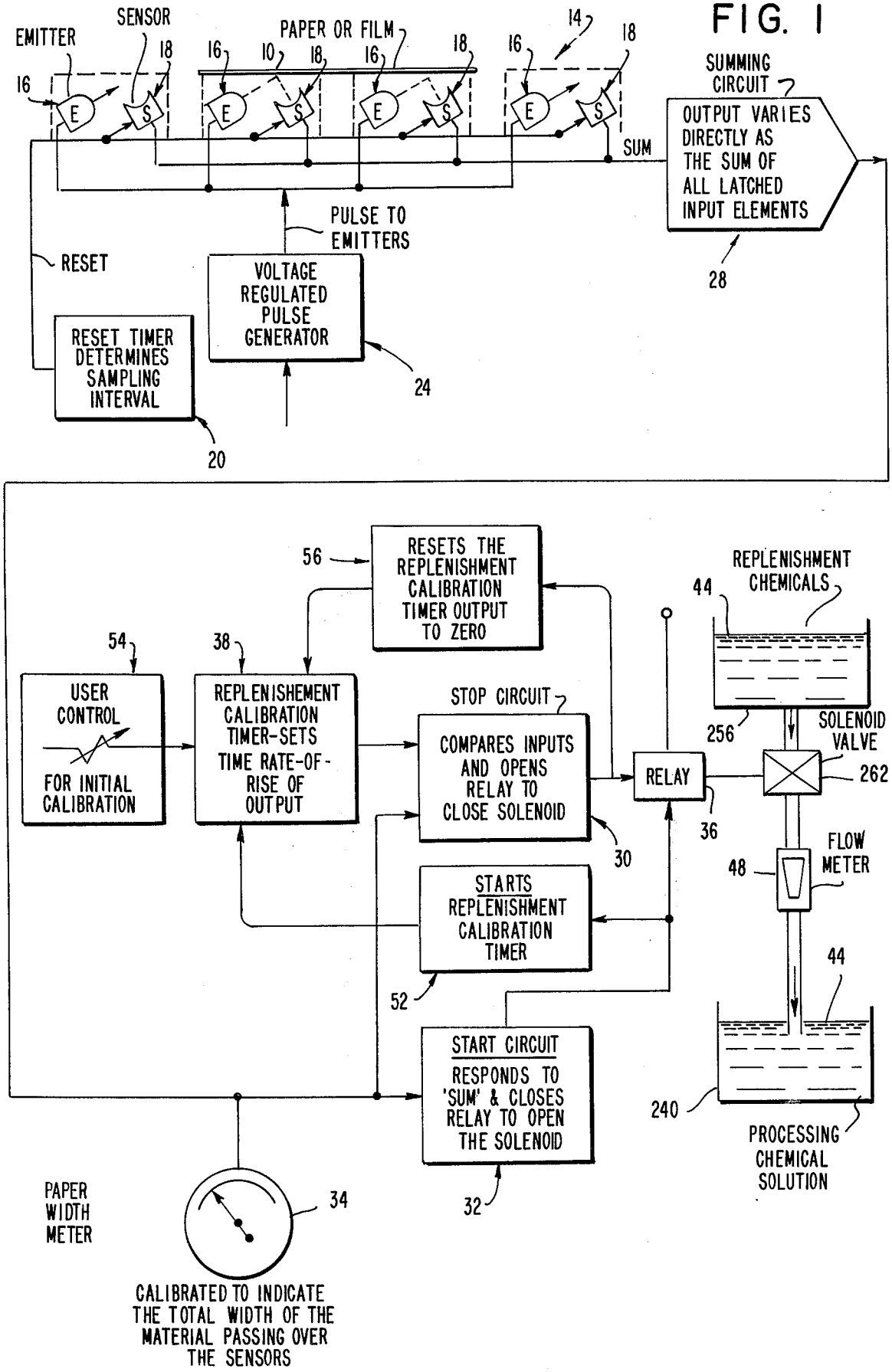
FIG. 1 is a schematic diagram for the electrical circuitry of the infrared sensed replenishment system.

Referring in detail now to the drawings wherein similar or like parts of the invention are identified by like reference numerals, a processor, generally illustrated as 11, essentially includes a feed module means 200, a chemical/wash module means 202, a dryer module means 204, and a transport means 206.

Feed module means 200 (see FIGS. 2 and 4) generally comprises a feed slot (not shown in the drawings), a feed table 12, infrared sensing means 14, temperature control units 207, circulation and replenishment pumps 208, heat exchangers 210, having temperature probes 209 attached thereto, water control panel means 212, a drive motor (not shown in the drawings), replenishment venturi tees 214, tank drain valves 216, drain pans 218, and chemical filters 220. Also included within feed module means 200, but not shown in the drawings, are a transport drive switch (auxiliary), a vent fan, an electrical connector channel, and power distribution cables.

The foregoing elements of the feed module means 200 should be construed illustratively since many additional components which were not specifically stated might also be included within the feed module means 200.

Water control panel means 212 (see FIG. 4) preferably contains a hot/cold water intake manifold 222, a temperature blender 224, a clean-up spigot 226, a solenoid 228, a water saver 230, a filter 232, vacuum breakers 234, flowmeters 236, and valves 238.

Figure 3:
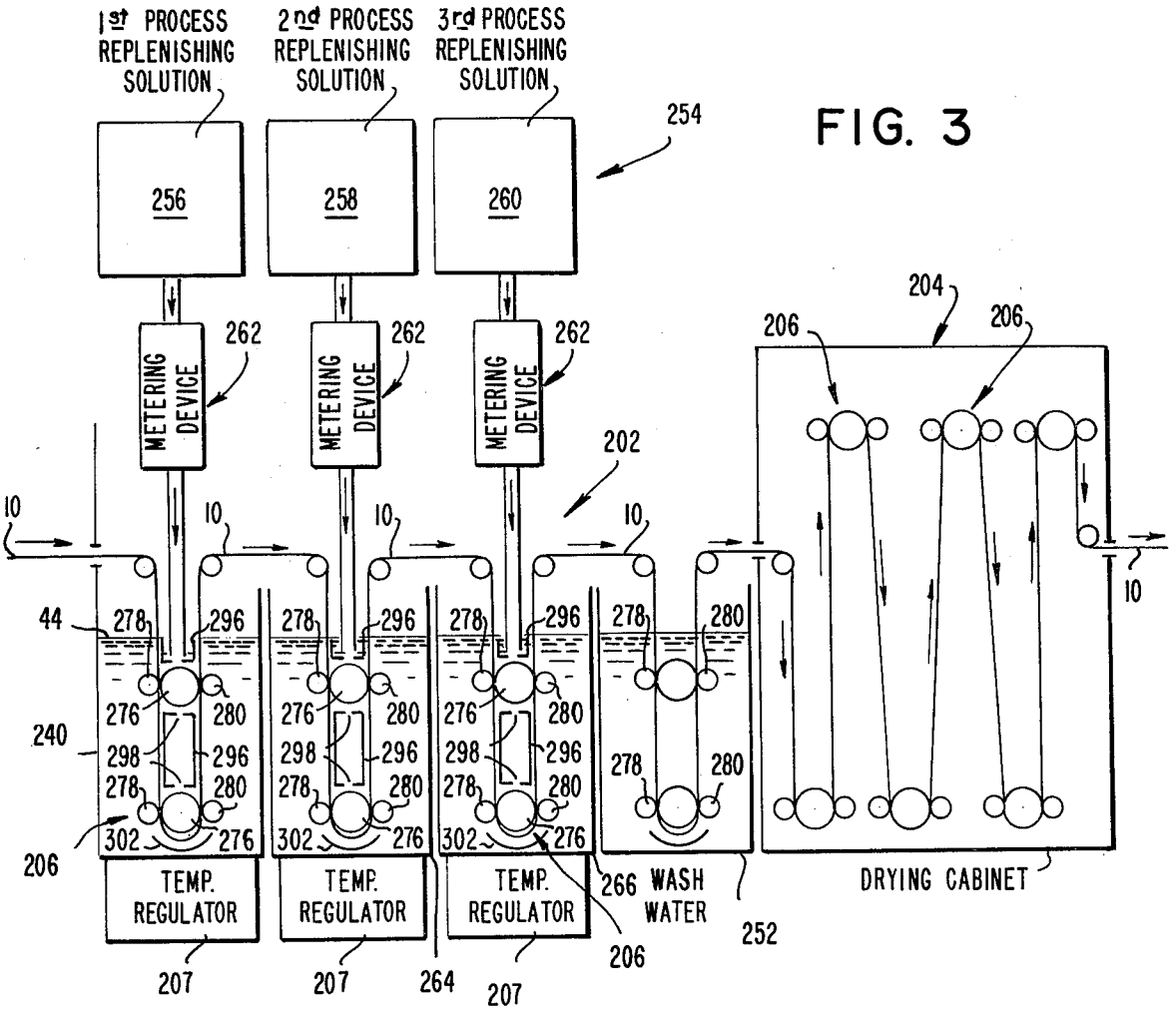
FIG. 3 is a schematic diagram showing the transport system moving film through processing solutions for development.
Figure 4:
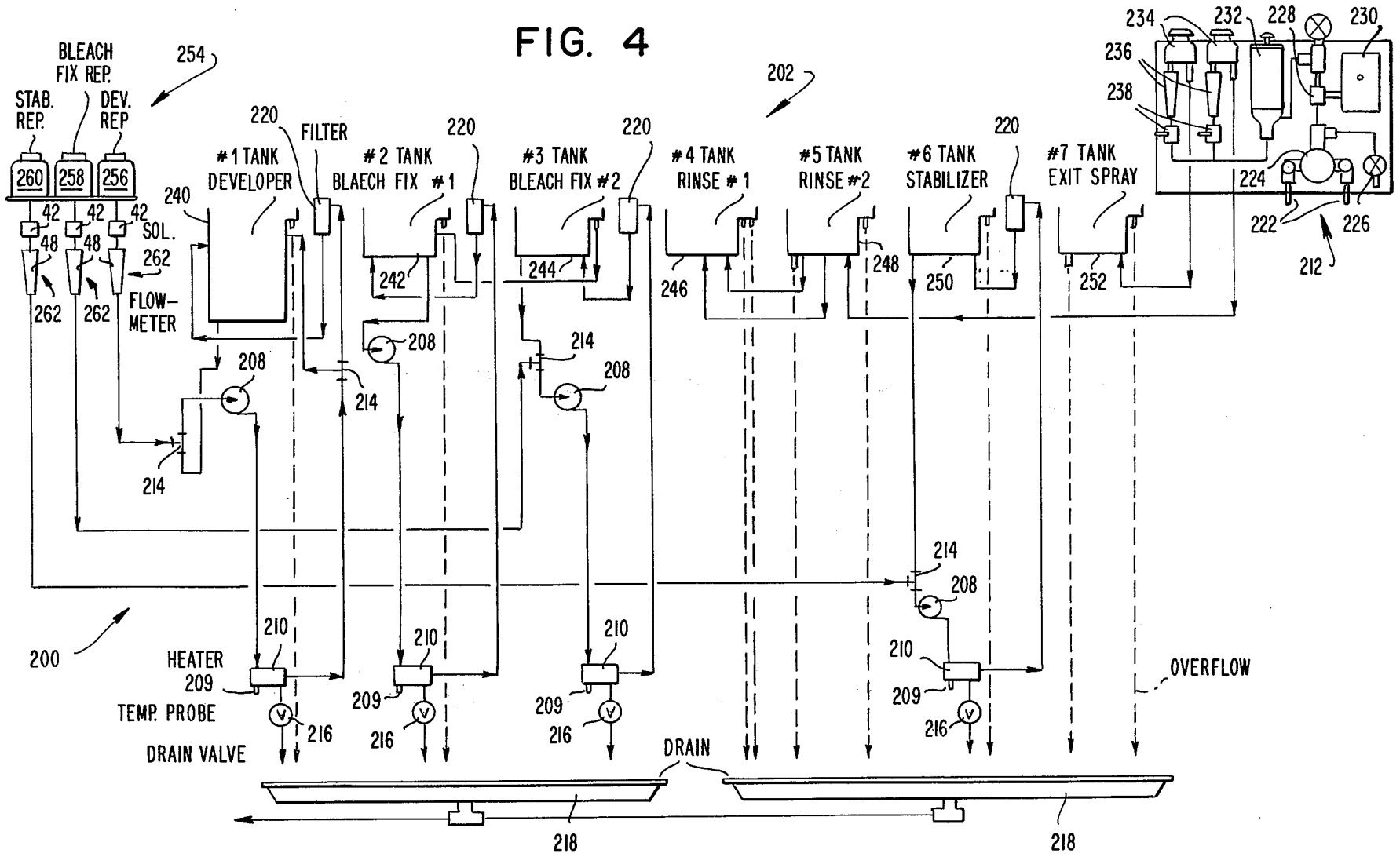
FIG. 4 is a schematic flow diagram illustrating the replenishment liquid flow from the respective reservoirs to the respective processing tanks.

FIG. 3 illustratively discloses chemical/wash module means 202 in a simplified schematic diagram showing some of the principle elements generally employed in photo-materials processors 11. The steps illustrated are considered basic but not typical of any processor 11. For example, reservoirs 254 in FIG. 3 are represented to include first, second and third replenishing solutions contained with tanks 256, 258, and 260, respectively. These replenishing solutions may respectively be developer, stop bath, and fixing bath for black and white materials or developer, bleach-fix, and stabilizer for color materials with various washing steps between bleach-fixing and stabilizing as is disclosed in FIG. 4, the schematic for developing color materials which will be additionally explained in the following paragraph. Tanks 256, 258, and 260 in FIG. 3 discharge their respective replenishment solution through a metering device, generally illustrated as 262 and having (as shown in FIG. 4) a solenoid valve 42 and a flow meter 48, into the developing tanks 240, a stop-bath tank 264, and a fixing bath tank 266, respectively. It should be pointed out that FIG. 3 does not disclose the numerous aforementioned elements of the feed module means 200 (of FIG. 4) which are situated after the metering device 262 and are obvious to those possessing ordinary skill in the art of photographic film processing.

FIG. 4 discloses the chemical/wash module means 202 sequentially developing a color paper or color film 10 and preferably comprises a developing tank 240; a bleaching tank 242, a second bleaching tank 244, rinse tanks 246 and 248, stabilizer tank 250, and exit spray or final rinse/wash tank 252. Chemical/wash module means 202 also includes the transport means 206 situated within each of the previously mentioned tanks, and reservoirs, generally illustrated as 254, which contain the respective processing solutions for each of the respective tanks.

Dryer module means 204 generally contains transport means 206, upper heater fans (not shown in the drawings) which are thermostatically controlled, lower heater fans (not shown in the drawings) which preferably run continuously, and a vent fan (not shown in the drawings) which is activated whenever the dryer switch (not shown) is turned off. The vent fan pulls fresh and unheated air into the dryer compartments. Also included within dryer module means 204 and not shown in the drawings are the following: a hinged master control panel, a tension idler for main drive chain adjustment, an inlet for external power cable, and miscellaneous elements which are obvious to those skilled in the art. The master control panel preferably includes an AC power toggle switch (and red indicator light) which furnishes power to the processor 11; a pushbutton switch (and a white indicator light for transport drive) which energizes the drive motor to set the transport system 206 in motion; a toggle switch for recirculating pumps 208 and temperature control regulators 207 which activate the circulation of all chemicals and the chemical heating system; a replenishment toggle switch to energize all units involved in chemical replenishment; a dryer toggle switch to energize both upper and lower heater fans and the vent fan in the dryer compartment; and temperature indicator lights which indicate whether or not the chemical solutions are at the correct temperature. Of course, the master control panel may include sundry other switches (well known to those skilled in the art) such as a take up reel toggle switch to energize the take up reel motor, and etc.

The transport means 206 broadly comprises rollers, generally identified as 268 (see FIG. 6) bottom turn around guides 302 and various other elements (not shown in the drawings) which are obvious to those skilled in the art, such as a 80 tooth transport drive gear, guides (entrance/exit, outer assembly), and a transport chain to drive the rollers 268.

Figure 6:
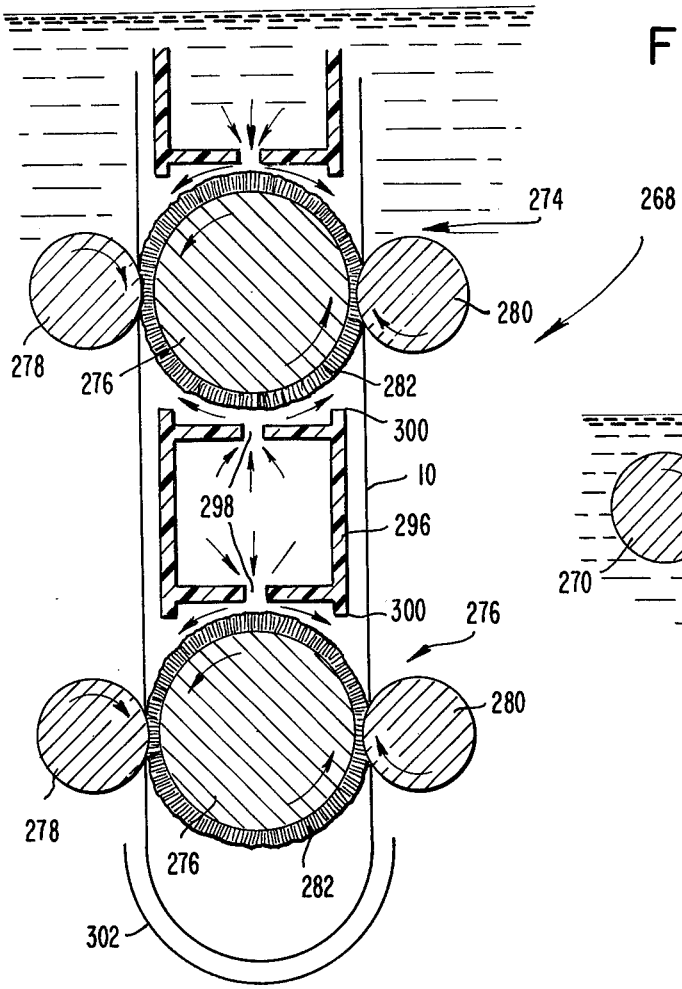
FIG. 6 is a fragmentary vertical section of two sets of rollers, each illustrating the transport means of the present invention.
Figure 8:
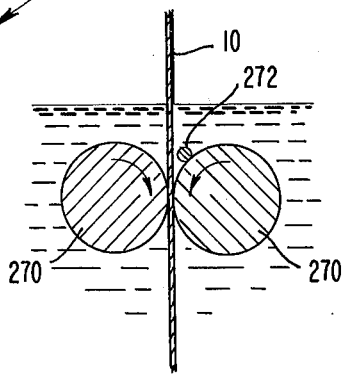
FIG. 8 PRIOR ART
FIG. 8 is an illustration of the prior art.
Figure 7:
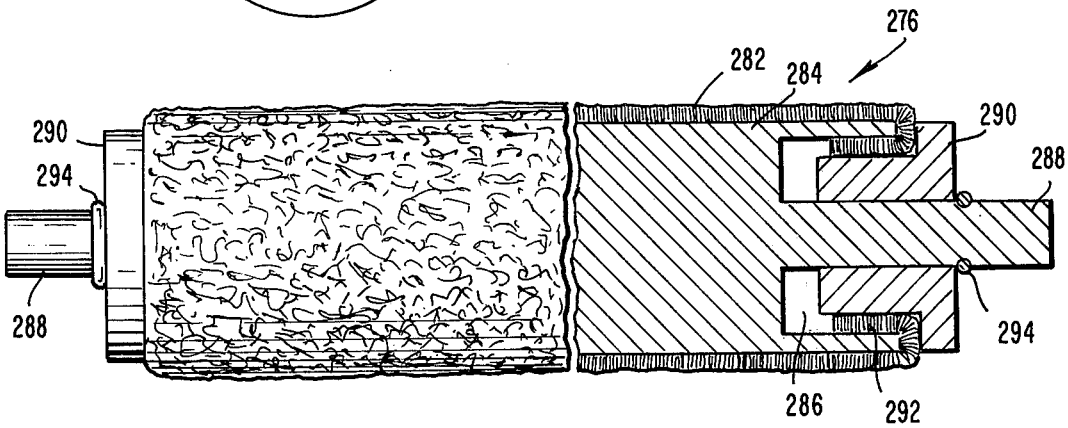
FIG. 7 is a side view of the fabric covered rollers with portions broken away and shown in longitudinal section.

Referring in detail now to FIGS. 6–8 for the novel roller embodiment of the invention, a typical pair of prior art rollers 270 are shown transporting a film 10 in a chemical solution. As these smooth surfaced rollers drive the film 10 therebetween, a squeegee action takes place on the film 10 causing the exhausted chemicals on the emulsion side of the film 10 to build up a bead 272. This build up is particularly bad when the film 10 moves in a vertical direction because the exhausted chemicals or bromide salts are heavier than the developing solution.

Now referring to FIG. 6, the stocking roller of the present invention is illustrated by two separate roller sets, generally identified by reference numerals 274 and 276. Each set includes a larger stocking covered roller 276 with a pair of smaller companion rollers 278 and 280, one on each side. While only two sets are shown, any number may be used depending upon the time interval that the film 10 is to be exposed in any particular chemical solution. For example, in the fixing tank 242 there might be half as many rollers as in the developing tank 240. The film strip 10 passes the stocking roller 276 on its left side, traveling downward, and returns traveling upward on the right side of the stocking roller, as indicated by the arrows. Each stocking roller 276 has a pair of smaller companion rollers 278 and 280 located on opposite sides thereof which press the film 10 against the stocking covering 282. In the absence of the film, each smooth surfaced companion roller 278 and 280 partially compresses the fabric or nap of the stocking covering 282. The axis of rotation of the stocking roller 276 and the companion rollers (278 and 280) are fixed with respect to each other, leaving the tolerance between the rollers to the resilient stocking 282. This added tolerance maintains an even pressure across the rollers at all times.

Each roller 276, as seen in FIG. 7, has a hard surface core 284 with concentric cavities 286 in each end. The rollers can be made of various plastics and metals that will not react with the chemical solutions utilized. Extending from each cavity 286 is a journal 288 for rotatably supporting the roller 276. The stocking 282 is a seamless woven or knitted material having a tubular shape. The stocking 282 is mounted on the roller by the inserting of plugs 290 over the journal ends 288 of the roller. The inner end 292 of the plug 290, pinches the end of the stocking 282 into the cavity 286, stretching the stocking taut on the roller core 284. Snap ring 294 releasably holds plug 290 in place.

The stocking material 282 can be any natural or synthetic fiber which is not affected by the chemical solutions it is in contact with. Woven cotton, nylon fiber flocking and wool with a looped nap have worked very well. The nap can also be cut. A sheared natural wool fleece bonded to the rollers with an adhesive can also be used. Any type of fibrous weave or knit which is open so that a low velocity fluid flow will easily wash out the collected exhausted chemicals can be used. Cellular plastic foams are not usable since they have a tendency to retain the exhausted chemicals and also there is not the vigorous agitation action that is achieved with a resilient fiber.

Positioned between each set of rollers 274 and 276 is a distribution chamber 296 which dispenses the fresh solutions of chemistry on the stocking roller 276. At a very low velocity, the fresh solution flows out the longitudinal slots 298, bathing a substantial portion of the stocking roller 276 between contact points with the film. Distribution chamber 296 also includes edges 300. A turn around guide 302 is situated underneath chamber 296. Various other film guide members are not shown in the drawings (as was previously mentioned) for purposes of simplicity, since they are not a part of the invention and are well known in the art.

Processor 11 additionally includes an infrared sensing electrical circuitry for electrically conducting the invention and will be described in detail by referencing FIGS. 1 and 5. The paper or film 10 passes over a feed table 12 and into a feed slot (not shown in the drawings) of processor 11 wherein the plurality of infrared sensing means 14 are situated. Sensing means 14 is electrically connected to a power source (described hereinafter) and comprises a plurality of emitters, generally illustrated as 16 each including an infrared emitting diode 104 and a resistor 102 in series therewith on conductor 101; and a plurality of sensors 18. Conductor 101 connects across conductors 128 and 130 which have separable connector means 132. Sensors 18 are electrically connected to a reset timer circuitry 20 via conductors 118, 120 and 320 for determining the sampling interval. The sensing means 18 of infrared means 14 has a conductor 112 attaching across a pair of conductors, 116 and 120, as well as a conductor 114 connecting across a conductor 118 and the conductor 116. A photo darlington transistor 100 is electrically connected on conductor 112 in series with a gate resistor 106, and a programmable unijunction transistor (PUT) 108 is electrically connected on conductor 114 in series with an anode resistor 110. Transistor 108 includes a gate electrode 111 connecting between transistor 100 and gate resistor 106. Conductors 116, 118 and 120 also include the separable connector means 132.

An optional emitter-sensing input circuit may include the emitter means 16 in conjunction with a sensing means 18 including a silicon photo switch means 122 attaching with conductors 113 and 115. In series with switch means 122 on conductors 113 and 115 are resistors 124 and 126, respectively. Conductor 115 connects across conductors 116 and 118 via switch 122 whereas conductor 113 attaches to conductor 120 and to switch 122.

Emitter means 16 are electrically connected via conductors 128 and 130 to a voltage regulated pulse generator circuitry, generally illustrated as 24, for generating a pulse width and repetition rate. The time width of the pulse generated by this circuit 24 is purposely made to be sufficiently short to assure that no photo exposure effects will appear on the photosensitive material due to the infrared emission produced by emitter 16. The emitters 16 used in this embodiment are preferably silicon diodes radiating principally in the band of wavelengths from 800 nanometers to 1000 nanometers. Commonly used photosensitive materials have low sensitivity over the 800 nanometer to 1000 nanometer range, but the exposure effect is eliminated by suitably shortening the exposure time. The sensor circuit of each emitter 16-sensor 18 pair latches upon receipt of reflected infrared energy off the surface of the paper or film 10, and continues to contribute a definite value of input through conductor 116 to a summing circuit, generally illustrated as 28, until interrupted by the next pulse from the reset timing circuitry 20. Summing circuit 28 is electrically connected to each sensor 18 by conductor 116 and has an output which varies in magnitude directly as the sum of all latched input elements.

Figure 5:
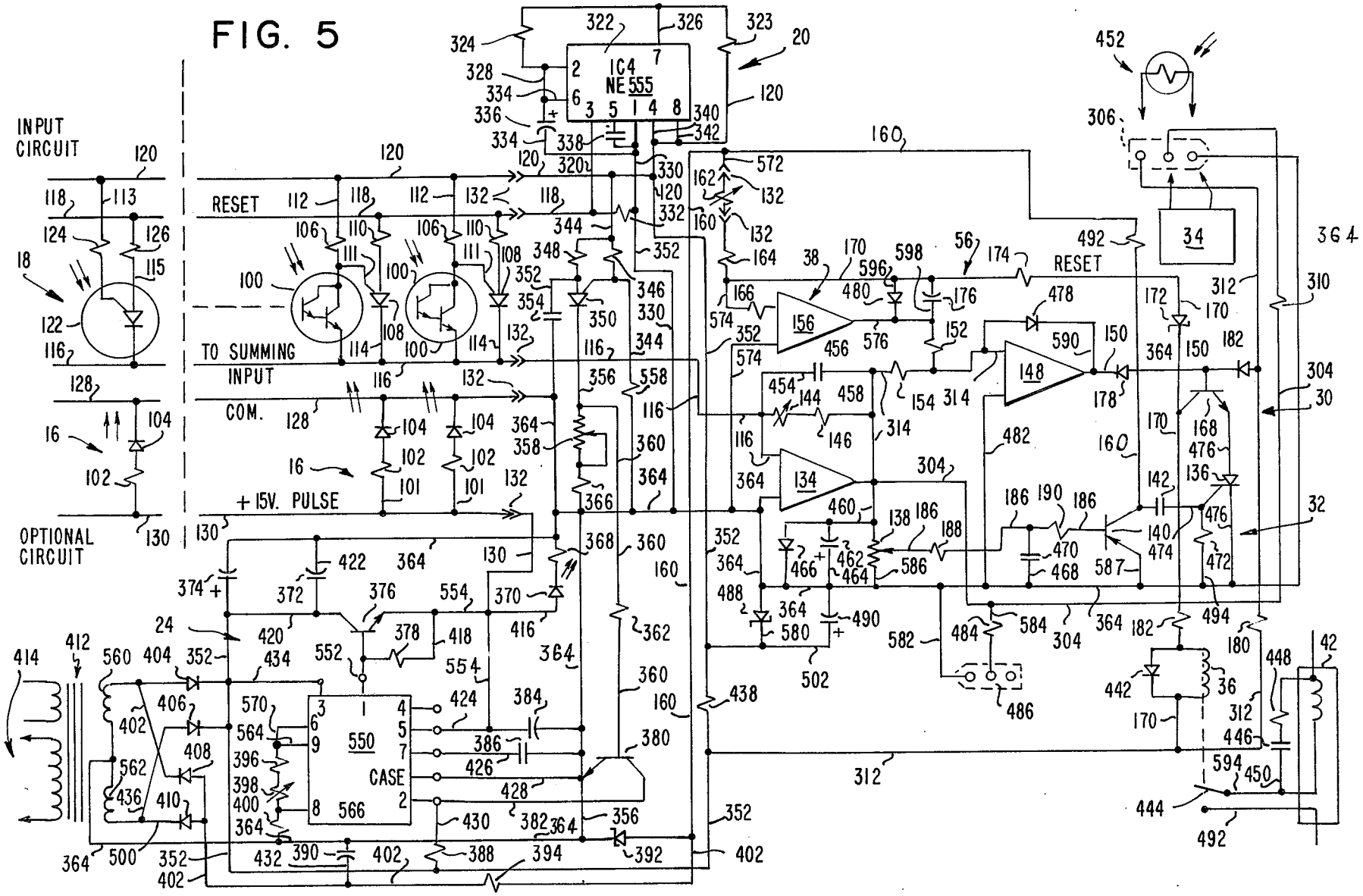
FIG. 5 is the preferred embodiment of the circuitry diagram for the infrared replenishment system.

FIGS. 1 and 5 respectively disclose only four and two sets of emitter 16-sensor 18 means but any suitable number may be used, depending on the size of the processor 11. The operator of processor 11 should insure, for proper operation of the invention, that the paper 10 is fed over at least one set of emitter 16-sensor 18 means to insure proper replenishment.

The summing circuit 28 is electrically attached to a start circuit, generally illustrated as 32, by conductor 460, resistive voltage divider 138 and conductor 186 having a resistor 188 in series in order stated. Conductor 304 has a resistor 310 connected in series with connector 306 which has a paper width meter 34 attached thereto. Summing circuit 28 is also in electrical communication with a stop circuit, generally illustrated as 30, through a conductor 314 having a resistor 154 in series with the stop circuit 30. In addition to the visual information provided by paper width meter 34 (or meter 486), a suitable audible signal (not shown in the drawings) may be made to indicate either that the processor's input slot is filled or that it is partially vacant.

The start circuit 32 responds to the sum of all latched input elements from the summing circuit 28 and closes a relay 36 and starts a replenishment calibration timer, generally illustrated as 38. Relay 36 opens or closes a solenoid valve 42. Replenishment chemicals 44 flow from tank 256 through solenoid valve 42, flow meter 48 (in order stated) into tank 240. Of course, as was previously mentioned, between flow meter 48 and tank 240 of FIG. 1, it is to be understood (as recognized by those skilled in the art) that various elements of feed module means 200 are situated.

Replenishment calibration timer 38 is initially calibrated by an operator's calibration control, generally illustrated as 54, which sets the time rate of rise of the electrical output of the replenishment calibration timer. The stop circuit 30 compares the sum of all latched input elements from summing circuit 28 and the output of the replenishment calibration timer circuitry 38, and when the output of timer circuitry 38 becomes slightly greater than the output of summing circuit 28, the stop circuit 30 opens the relay 36 to close the solenoid 42 and also to reset the output of replenishment calibration timer circuitry 38 to zero via a reset circuitry, generally illustrated as 56. For any combination of flow meter 48 settings and replenishment calibration timer circuitry 38 settings, the delivered volume of replenishment chemicals 44 is directly proportioned to the area of the paper or film 10 passed over the feed table 12 and into the feed slot wherein the infrared sensing means 14 are located.

Replenishment calibration timer circuitry 38 controls the replenishment process with the relayed impulses from the infrared sensing means 14, and the reset timer circuitry 20 (or a revolution counter circuitry) whose associated components yield a replenishment command signal to cause a voltage drop to zero for a certain interval of time following successive time intervals, each of which is equal to the time required for the processor drive (not shown) to turn one revolution; this enables detection of the running length of the paper or film 10 as it passes through the processor 11. A revolution counter circuitry may be a simple mercury switch with various components located on the drive side of the chemical/wash module means 202, but it is preferably the reset circuitry 20 as disclosed in FIG. 5.

Reset timer circuitry 20 preferably includes a NE 555 monolythic timing circuit 322 having junctions 1–8 and the following: conductor 118 attaching to conductor 330 and including a resistor 332 in series; a conductor 320 connecting from junction 3 of monolythic timing circuit 322 to between separable connector means 132 and resistor 332; and conductor 120 attaching to junction 2 of timing circuit 32 and having resistors 323 and 324 in series therewith. Conductors 340, 342 and 326 attach from conductor 120 to junctions 4, 8, and 7, includes polarized capacitor 336 in series and connects from conductor 330 to junction 6 of timing circuit 322. Capacitor 338 attaches from junction 5 of timing circuit 322 to conductor 330 which hooks into junction 1 and to conductor 364. Conductor 328 interconnects conductors 120 and 334 immediately prior to junctions 2 and 6 of timing circuit 322.

Power for all circuits is derived from a power source generally illustrated as 414 which is preferably about 115 V AC. Source 414 feeds transformer 412 having windings 560 and 562 connected with diode rectifiers 404, 406, 408 and 410 in a conventional dual full-wave center-tapped rectifying configuration in which the junction of windings 560 and 562 join with conductor 364 to connect the power source to the positive terminal of energy storage capacitor 390 and to the negative terminal of energy storage capacitor 372 and to the negative terminal of energy storage capacitor 374. Conductor 364 is also a common conductor interconnecting all circuits and is the conductor to which all electrical polarities and all signal levels are referred and for this purpose is considered to be at zero electrical potential. Conductor 352 is at an electrical potential of about +24 volts where it interconnects conductor 420 and the anode terminals of capacitors 372 and 374 with the cathode terminals of rectifying diodes 404 and 406. This +24 volt potential is supplied through conductor 352 to one terminal each of conductor 434, resistor 388, resistor 438 and conductor 312. Conduction through resistor 438 supplies positive polarity direct current to conductor 502 where the voltage is stabilized and regulated at about +15 volts by capacitor 490 and shunt regulator diode 488. A negative 15 volt bias and reference potential is similarly derived by rectification through diode 408 and 410, energy storage in capacitor 390, conduction through resistor 394 and conductor 160 which junction then provides a virtually constant voltage source of about negative 15 volts. This source supplies bias via conductor 160 to conductor 572 and to one terminal of resistor 492. Electrical energy stored in capacitors 372 and 374 also supplies the requirements of the voltage regulated pulse circuit 24.

The following paragraph will depict the voltage regulated pulse circuit 24. It broadly comprises a sampling interval timer which includes the programmable unijunction transistor 350 and it's associated components, resistor 346, resistor 558, resistor 348, capacitor 354, adjustable resistor 358 and resistor 366 all of which components together with transistor 350 are connected in a circuit configuration commonly known as a relaxation oscillator which circuit delivers a brief positive voltage pulse whose amplitude and duration and repetition rate are set by the values of the circuit components. The preferred repetition rate for this application is about one pulse per second and this rate is determined in part by the time constant of the RC network formed by resistor 348 and capacitor 354 and in part by the voltage level at which transistor 350 goes into conduction, this voltage level being determined by the characteristic offset between anode and gate of transistor 350 plus the gate voltage on transistor 350 which voltage is determined by the proportional values of resistors 558 and 346. The preferred pulse duration is about one millisecond which is sufficiently brief to prevent photo exposure effects on the sensed material. This one millisecond pulse width is set by adjusting resistor 358 which in series with resistor 366 provides a discharge path for capacitor 354. A sufficient portion of the current flowing from capacitor 354 through conductor 356 is diverted through conductor 360 and resistor 362 to the base of transistor 380 to cause transistor 380 to conduct and thus to remove the bias current from terminal 2 of voltage regulator module 550 by diverting this current through conductor 382 and the collector to emitter path of transistor 380 directly to common conductor 364. Removal of the inhibiting bias activates module 550 which in turn biases the power transistor 376 into conduction resulting in a regulated voltage pulse on conductor 554 with a nearly constant amplitude of +15 volts for a time duration of one millisecond. The pulse amplitude is settable by means of variable resistor 398 which with resistors 396 and 400 acting in conjunction with the internal components of module 550, implement the required sensing and comparing functions characteristic of the preferred type of monolythic voltage regulator 550 chosen for this application. The output pulse appearing on conductor 554 is connected via conductor 424 to the output sensing terminal of module 550. Capacitors 384 and 386 improve the stability of the circuit and help to minimize transient responses other than the essentially uniform pulse of about one millisecond duration required for supplying current to the infrared emitters 104. Conductor 428 connects the case which is specified as the ground terminal of module 550 to the common conductor 364 as required to complete the return path for the internal circuitry of module 550.

Summing circuitry 28 broadly comprises a conductor 116 attaching to the summing amplifier 134 which has a feedback circuit attaching to conductors 116 and 314. The feedback circuit consist of a conductor 458 having in series a variable resistor 144 and a resistor 146. Conductor 454 attaches on conductor 116 across resistors 144 and 146 to conductor 314. Conductor 314 connects from conductor 304 to a comparator amplifier 148 of stop circuit 30 and it has a resistor 154 between the junction points of conductor 454 and a conductor 576. Also attaching with summing amplifier 134 are conductors 304 and 364. Conductor 574 is also connected to conductor 364 and to a calibration timer amplifier 156; and conductor 364 attaches to the components of a start circuit 32 and a connector 306. Conductor 364 has a photocell, generally illustrated as 452, attaching thereto and to conductor 312 to inhibit and shut down replenishment when darkroom lights are on. Between the junction of conductor 364 on summing amplifier 134 and connector 306 are the junctions of the following conductors: 580, 460 and 502, 586, 582, 482, 468, 587, 494, and 476. Conductor 582 attaches to connector 486 from a paper width meter 34. Connector 486 has conductor 584 interconnecting it with conductor 304 and includes a resistor 484 thereon. Conductor 502 interconnects conductors 352 and 364 and includes a polarized capacitor 490 between the junction point with conductor 364 and junction point with conductor 580. Conductor 460 interconnects conductor 304 with conductor 364 and junctions with the conductor 464 having a polarized capacitor. Between the junction points of conductors 464 and 364 on conductor 460 is a diode 466. Conductor 460 also unites with a conductor 314 and a conductor 586 including a variable resistor 138.

The latter conductor (586) junctions on conductor 460 between the junction points of conductor 464 and conductors 304/314. Variable resistor 138 attaches with conductor 186 which also unites with start circuit 32. Resistor 188 is situated on conductor 186 in series between variable resistor 186 and start circuit 32.

Start circuit 32 includes conductor 186 having a resistor 190 and connecting to base electrode of transistor 140. Conductor 468 having a capacitor 470 attaches to conductor 186 between resistors 188 and 190. The latter resistor (190) is situated between the junction point of conductor 468 and the base electrode of the transistor 140 which has its emitter electrode connecting to conductor 587. A conductor 474 has a capacitor 142 and connects at the junction point of collector electrode of transistor 140 and conductor 160. Conductor 474 also attaches to the junction point of the conductor 494 (having a resistor 472) and a thyristor 136 which also has a conductor 476 interconnecting it with conductor 364.

Stop circuit 30 comprises a trnsistor 168 having its emitter electrode attaching to thyristor 136 via a conductor 476 and its collector electrode connecting to a conductor 170. Base electrode of transistor 168 attaches to conductor 150 which interconnects a comparator amplifier 148 with the conductor 312. A diode 182 is positioned on conductor 150 between the connection points of the base electrode of transistor 168 and conductor 312. Between the union points on conductor 150 of comparator amplifier 148 and base electrode of transistor 168 are the following commencing from comparator amplifier 148: the junction point of a comparator amplifier feedback conductor 590 which also connects to conductor 314 and has in series a diode 478; and a diode 178. A conductor 482 attaches from the comparator amplifier 148 to the conductor 364.

Reset circuitry 56 has the conductor 170 interconnecting the conductor 572 with the conductor 312. Between the union point of the collector electrode of transistor 168 and the junction of conductor 312 on conductor 170 are the following in order stated: a resistor 182, and the relay 36 having in parallel therewith a diode 442. Relay 36 is in electrical communication with a switch 444 which closes/opens to open or close the solenoid valve 42. Conductors 592 and 594 are contactable with switch 444 and connect with the solenoid valve 42. A conductor 450 interconnects conductor 594 and solenoid valve 42 and has in series (from the solenoid valve 42) a resistor 448 and a capacitor 446. Between the junction of the collector electrode of transistor 168 and the junction of conductor 170 on conductor 170 are (in order stated from conductor 170) the junction points of conductors 596 and 598, a resistor 174 and a diode 172.

Replenishment calibration timer circuitry 38 comprises the conductor 576 having a resistor 152 and interconnecting calibration timer amplifier 156 and conductor 314. Conductor 598 interconnects conductors 170 and 576 between the calibration timer amplifier 156 and the resistor 152. Conductor 596 also interconnects conductors 576 and 170 but at a point between the calibration timer amplifier 156 and the junction point of conductor 598 with conductor 576.

The Calibration Control circuitry 54 includes a conductor 572 which interconnects conductor 160 with the calibration timer amplifier 156. Conductor 572 has a resistor 166 in series between calibration timer amplifier 156 and the junction point of conductor 170. Between conductor 160 and the union place of conductors 170 and 572 are the following: separable connector means 132, a variable resistor 162, a separable connector means 132 and a resistor 164, in order stated from conductor 160.

Representative component designations and preferred circuit values for the FIG. 5 circuit are as follows:

| | |
|---|---|
| Resistor 124 | 22 Megohms |
| Resistor 126 | 150 KΩ |
| Resistor 106 | 200 KΩ |
| Resistor 110 | 510 KΩ |
| Resistor 324 | 3.3KΩ ± 5% |
| Resistor 310 | 10 KΩ ± 1% |
| Resistor 102 | 68Ω |
| Resistor 332 | 22 KΩ |
| Resistor 348 | 270 KΩ |
| Resistor 346 | 11 KΩ |

-continued

| | |
|---|---|
| Resistor 358 | 100Ω |
| Resistor 366 | 22Ω |
| Resistor 558 | 22 KΩ |
| Resistor 362 | 470Ω |
| Resistor 368 | 220Ω |
| Resistor 378 | 100Ω |
| Resistor 396 | 18 KΩ |
| Resistor 398 | 10 KΩ |
| Resistor 400 | 6.8 KΩ |
| Resistor 388 | 4.7 KΩ |
| Resistor 394 | 470Ω |
| Resistor 438 | 470Ω |
| Resistor 138 | 20 KΩ |
| Resistor 188 | 10 KΩ |
| Resistor 484 | 10 KΩ |
| Resistor 448 | 1.5 KΩ |
| Resistor 182 | 1.6 KΩ |
| Resistor 180 | 100 KΩ |
| Resistor 190 | 10 KΩ |
| Resistor 472 | 1 KΩ |
| Resistor 174 | 22 KΩ |
| Resistor 492 | 100 KΩ |
| Resistor 152 | 10 KΩ1% |
| Resistor 154 | 10 KΩ1% |
| Resistor 166 | 100Ω |
| Polarized Capacitor 336 | 10 μF |
| Polarized Capacitor 372 | 1000 μF |
| Polarized Capacitor 374 | 1000 μF |
| Polarized Capacitor 390 | 100 μF |
| Polarized Capacitor 384 | 1 μF |
| Polarized Capacitor 490 | 10 μF |
| Polarized Capacitor 462 | 1.0 μF |
| Capacitor 470 | .05 μF |
| Polarized Capacitor 176 | 10 μF |
| Capacitor 338 | .01 μF |
| Capacitor 354 | 3.3 μF |
| Capacitor 386 | .001 μF |
| Capacitor 446 | .1 μF |
| Capacitor 142 | .05 μF |
| Capacitor 456 | .01 μF |
| Comparator Amplifier 148 | LM 741 CN |
| Summing Amplifier 134 | LM 741 CN |
| Calibration Timer Amplifier 156 | LM 741 CN |
| Diode 488 | SZ 15 ± 1% |
| Diode 466 | 1N 4002 |
| Diode 442 | 1N 4002 |
| Diode 182 | 1N914 |
| Diode 178 | 1N914 |
| Diode 172 | 1N756 |
| Diode 478 | 1N4002 |
| Diode 480 | 1N4002 |
| Diode 392 | SZ 15 ± 1% |
| Diode 104 | MLED 60 |
| Diode 370 | MLED 50 |
| Diode 404 | 1N 4002 |
| Diode 406 | 1N 4002 |
| Diode 408 | 1N 4002 |
| Diode 410 | 1N 4002 |
| Transistor 108 | 2N 6028 |
| Transistor 100 | 2N 5779 |
| Transistor 122 | L14T1 |
| Thyristor 136 | 2N 2345 |
| Transistor 380 | 2N 2222A |
| Transistor 350 | 2N 6028 |
| Transistor 376 | 2N 3055 |
| Transistor 168 | 2N 2222A |
| Voltage Regulator Module 550 | MC 1469R |
| Relay 36 | 1600ΩCoil |
| Reset Timing Module 322 | NE 555 |
| Transformer 412 | Step Down From 115 VA. C. |
| Coil 560 | 17 VA. |
| Coil 562 | 17 VA. C. |

Resistors 358 and 398 are respectively set the pulse width to 1 m sec. and the pulse height to +15 v. Resistor 323 depends on the desired period; the longer the period, the larger Resistor 323 will be. For periods of 9.0 sec, 13.8 secs, and 27.0 secs, Resistor 323 will be 1.3 megohms ±5%, 2 megohms ±5%, and 3.9 megohms ±5%, respectively. Resistor 144 will be set near its midpoint due to the selected value of Resistor 146 in each case. For processors 11 of input slot widths 20 inches, 31 inches, 42 inches and 52 inches, R 146 will be 3.9KΩ, 2.2KΩ, 1.5KΩ, and 1KΩ, respectively. Resistors 144 and 146 set the trip level at 10 v when all input segments are active, or on.

OPERATION OF THE INVENTION

Preliminarily, and with reference to FIG. 1, the sensing scheme shown as emitter 16 with sensor 18 positioned to detect the reflection from the photosensitive material which is shown as paper or film 10 is the configuration used in the preferred embodiment of the invention. Other configurations have been tested and found suitable for the same purpose. As will be obvious to those skilled in the art, the emitter 16 sensor 18 pair can be placed above the plane of the feed slot so that reflection from the top of the photosensitive material indicates the presence of the material. Locating the emitter 16 and sensor 18 to detect the top of the paper or film 10 is equivalent electrically to the arrangement illustrated in FIG. 1 and requires no concomitant changes in the remainder of the circuitry. The choice of the emitter 16 and sensor 18 location must be such that the paper or film 10 presents a reflecting surface to the infrared emission of emitter 16. Certain photographic films have black or very dark light absorbing coloring in the film base. This coloring is removed during processing, but prior to processing, the reflection of infrared emission from the film base surface is insufficient for satisfactory detection by the sensor 18. The emitter 16 and sensor 18 of each emitter-sensor pair can be positioned to sense the emulsion surface of the film, or the emitter 16 and sensor 18 can be positioned facing each other so that the paper or film 10 passes between them, and the presence of paper or film 10 is detected when it interrupts the pulsed infrared emission passing between the emitter 16 and sensor 18 of any emitter-sensor pair. Certain minor changes in the details of the electrical circuits of schematic diagram FIG. 1 readily apparent to those skilled in the art, are required when the sensing is done by interrupting the infrared pulses but the scheme as represented by FIG. 1 is applicable to either sensing method.

With continued reference to the drawings for operation of the invention, and in particular, FIG. 5, as paper 10 passes over the feed table 12 and into the feed slot (not shown in the drawings), infrared pulses from emitter diodes 104 of infrared means 14 are reflected off the photosensitive material 10 to transistor 100 whose spectral response peak matches emitter diode 104. Transistor 100 now conducts momentarily to drop the gate voltage to programmable unijunction transistor 108 which subsequently latches due to the holding current through resistor 110. Conduction through resistor 110, resistor 106 and transistor 108 is now independent of photo transistor 100 and will continue until anode current through resistor 110 is interrupted. In a preferred embodiment, this conduction supplies about 0.1 mA input to summing amplifier 134 of summing circuit means 28 for each transistor 108 that has been turned on.

Input pulse via conductor 116 to summing amplifier 134 of summing circuit means 28 is proportional to the width of photosensitive material 10 in the slot. Prior to the input pulse, there is no output from summing amplifier 134 and thyristor 136 cannot be turned on. The step increase in output of amplifier 134 biases gating switch transistor 140 (preferably a PNP transistor) on to discharge condenser 142 through the gate of thyristor 136; this activates thyristor 136 and the relay 36 via transistor 168 which is preferably a silicon NPN switching transistor.

The gain of summing amplifier 134 is set by the feedback conductor 458 having variable feedback resistor 144 in series with feedback resistor 146. This yields a desired voltage (e.g. 10 volts for full width input to the processors feed slot) at the output of summing amplifier 134 where conductors 314, 304 and 460 all unite.

The output from summing amplifier 134 sets the sense or trip level for comparator amplifier 148 of stop circuit means 130. Amplifier 148 has output via conductor 150 which is either positive or minus (e.g. −0.5 v or +12 v) voltage saturation; this depends on which is the greater of the opposing currents through resistor 152 and 154.

When output of comparator amplifier 148 is at a positive voltage saturation (e.g. about 12 volts), diode 178 is reverse biased and passes no current. Transistor 168 is biased on by the current through resistor 180 allowing current to flow through thyristor 136, but thyristor 136 must be gated on to complete the circuit and energize relay coil 36. When output of summing amplifier 134 goes from zero to some negative voltage, any test point on conductor 186 between resistor 138 and resistor 188 goes negative; and, depending on the magnitude of voltage at the output of amplifier 134 on conductor 304 and the setting of resistor 138, bias current through resistor 188 and resistor 190 to base of transistor 140 turns transistor 140 on. Capacitor 142 is charged to −15 v on conductor 160 between transistor 140 and resistor 492. Turning transistor 140 on, as was previously mentioned, discharges capacitor 142 through the gate of thyristor 136 to turn on thyristor 136 and energize relay 36.

When output of comparator amplifier 148 is at about −0.5 v, the bias on transistor 168 is nearly zero and thyristor 136 cannot be gated on. No current flows through transistor 168; however, about 0.6 mA flows into the inverting pin of integrator amplifier 156 (on conductor 170) through, in order stated, relay 36, resistor 182, diode 172 and resistors 174 and 166. This forces the output of amplifier 156 to about −0.5 volts and consequently, the output of comparator amplifier 148 to positive voltage saturation which allows transistor 168 to be biased on; thus making thyristor 136 ready to be biased on by the next gate pulse.

Two timing pulses are part of the sequence of events; one of these is closely interrelated with the power supply 414 section of the circuit. The power supply 414 section provides about 1% zener regulated +15 v and −15 v for amplifiers 134, 148 and 156. The +15 v is also the reference voltage for the light activated (infrared silcon switches (transistors 100 and 108) located in the processor's 11 input slot. The −15 v is the reference for the time calibration integrating circuit means 38 and the PNP cycle starting transistor 140. The power supply section also provides approximately 24 v D.C. filtered (but unregulated) to the relay 36 coil circuit, and a square pulse having a current capability of about 10 amperes and presettable to +15 volts. Any width (time duration) from between 100 us to 1 ms is produced at the initiation of the sampling interval timer whose functionality will be explained hereinafter.

Calibration timer means 38 includes amplifier 156 which is connected as an integrator whose voltage output through conductor 576 rises at a rate proportional to the input current supplied to amplifier 156 from conductor 160 through calibration control means 54, resistor 164, and resistor 166, in order stated. Variable resistor 162 of control means 54 is a potentiometer which must be set by the installer or operator to coordinate input current rate with the selected fluid flow rate of the replenishment solutions. Once the correct rate is set, the replenishment will be correct for all widths of input to the processor 11. Resistor 162 preferably has a 5% independent linearity.

While thyristor 136 is off, the anode voltage of switching transistor 168 is positive (e.g. about 24 v) to feed sufficient current through reset means 56 having conductor 170 including in series diode 172 and resistor 174 and resistor 166 into the inverting input of amplifier 156 to force the output of amplifier 156 to go to about −0.5 v being limited to this negative level by the forward voltage characteristic of diode 480. The output of amplifier 156 is either negative (−0.5 v) or a positive going voltage ramp rising at a constant time rate and is taken between polarized capacitor 176 and resistor 152, i.e., on conductor 576.

If the output of amplifier 156 is positive, it drops to −0.5 the next time reset timing circuit means 56 passes current. When paper 10 is introduced into the input slot, the negative voltage at the output of summing amplifier 134 will sharply rise following the next infrared pulse, which, using the preferred circuit component values, occurs within one second and will remain at a negative voltage level which is directly proportional to the sum of the total paper (or other reflective material) width in the input slot.

As was previously mentioned, this negative transition of output at summing amplifier 134 turns transistor 140 on to discharge capacitor 142 through the gate of thyristor 136 to turn thyristor 136 on. Prior to this time, the input to comparator amplifier 148 is negative and its output through conductor 150 is positive (i.e. about +12 v) to reverse bias diode 178 to consequently permit transistor 168 to be biased on via resistor 180 and diode 182. As aforementioned, by turning thyristor 136 on, the relay 36 is completed and solenoid valve 42 is opened to discharge fluid flow in accordance with FIG. 4. Any point on conductor 170 between diode 172 and resistor 182 is currently less than about 1 v positive and there is no current through diode 172; output voltage of integrator amplifier 156 rises at a time rate established by the values of variable resistor 162, resistor 164, voltage on conductor 160, and polarized capacitor 176. The increasing voltage at the output of integrator amplifier 156 is compared on conductor 158 after resistor 152 (but prior to comparator amplifier 148) with the output voltage of summing amplifier 134 and a fast negative transition occurs at the output of comparator amplifier 148 on conductor 590 at the instant when the output of calibration timer amplifier 156 exceeds the reference level established by the then existing output of amplifier 134 at the junction of resistor 152 and 154 on conductor 314. Output voltage of comparator amplifier 148 is presently negative (i.e. about −0.6 v) and sinks transistor's 168 bias and turns it off terminating a replenishment cycle. Thyristor 136 subsequently stops conducting and relay 36 is deenergized to close solenoid valve 42 via switch 444. The inverting input (after resistor 166) to amplifier 156 is again biased positive through diode 172 and resistor 174 to cause amplifier 156 to discharge polarized capacitor 176, holding the output of amplifier 156 near zero thus resetting the circuits to the initial condition wherein the output voltage of comparator amplifier 148 now becomes positive and thyristor 136 is not conducting and will not conduct until paper is introduced into an otherwise empty feed slot or until the next actuation of reset timing module circuit means 20, and then only if paper 10 is in the feed slot.

The sampling interval timer is formed by programmable unijunction transistor 350 and associated components and gives about one pulse per second—this time period is not critical. Regulator 550 (MC 1469R) regulates the pulse amplitude and is normally maintained inhibited or "shut-down" by the bias current through resistor 388. The value of resistor 388 must be 6.8 K or less to pass 1 mA initially with conductor 130 "shorted" to common return or case point or Regulator 550 via conductors 364 and 428, in order stated. The minimum resistance value for resistor 388 is preferably equal to or greater than 2.4 K ohms.

The pulse from the cathode of transistor 350 through resistor 362 biases transistor 380 (i.e. a silicon NPN switch transistor) on, sinks resistor's 388 current and turns Regulator 550 and power transistor 376 on resulting in a regulated +15 volt pulse at a point on conductor 130. This pulse supplies current to all infrared emitting diodes 104. Power transistor 376 has a special characteristic of preferably being able to conduct 10 A at 0.1% duty cycle.

Any paper 10 introduced into the input slot will be sensed within one second (i.e. when the next infrared pulse occurs), and a number of transistors 108 (which in this embodiment are spaced one per inch) will latch on equal in number to the width in inches of paper 10. Connectors 486 and 306 provide for installation of appropriately calibrated meters 34 at either the input or output end of the processor 11, or both. Meter 34 indicates the total width of all strands of paper 10 that have entered the processor's 11 input since the last replenishment command signal which preferably occur every 27 seconds. This signal comes from the NE 555 monolythic timing circuit 322 whose associated component values are such that pin 3 of timing circuit 322 drops from 13.7 volts to zero for about 23 milliseconds following successive time intervals each of which is equal to the time required for the processor's 11 drive to turn one revolution. This eliminates the need for the transport-driven mercury switch of the prior art, but keeps this system fully compatible and interchangeable with those using the drive-actuated mercury switch.

Each time that pin 3 of timing circuit 322 drops to zero, all transistors 108 drop out of conduction and the input and output of summing amplifier 134 both go to zero. The next sampling pulse will occur within one second. If sensing means 18 detect paper 10 in the input slot, the voltage at the output of summing amplifier 134 on conductor 304 will rise, the meter 34 will indicate the total width of paper 10, and transistor 140 will be biased on which subsequently turns thyristor 136 on. This, as aforementioned, closes relay 36 and starts replenishment in accordance with FIG. 4. There is presently no current through diode 172, but current is being conducted through conductors 160 (having resistors 162 and 164) and 170 to the inverting input of integrator (calibration timer) amplifier 156 to cause a charge to build at a constant rate across capacitor 176 as output of integrator amplifier 156 supplies feedback current through capacitor 176 to the inverting input of integrator amplifier 156.

This is a conventional integrating operational amplifier operating mode which compels the voltage on output conductor 576 of integrator amplifier 156 to rise at a constant rate to provide the feedback or charging current, and this rise continues until the voltage at the output of amplifier 156 becomes a few millivolts greater than the voltage at the output of amplifier 134 at which time amplifier's 148 output immediately switches to about −0.5 v, taking transistor's 168 bias to zero and de-energizing the relay 36. Thyristor 136 is now out of conduction as was previously described and the junction point of the collector electrode of transistor 168 with conductor 170 has a high positive voltage which resets integrator amplifier's 156 output to zero via conductor 170. This also discharges capacitor 176, drives the output of comparator amplifier 148 high and transistor 168 on to await the next trigger pulse from transistor 140.

Resistor 138 is preferably set to ignore total input widths of less than 3 inches by appropriately setting the threshold at which transistor 140 will be biased on. When transistor 140 triggers thyristor 136 and starts the replenishment, the time will still be governed by the total width whenever the total is 3 inches or more since the full voltage at the output of summing amplifier 134 always sets the comparator threshold level.

As was previously mentioned, processor 11 preferably has a once-per-27 seconds replenishment command signal, and in addition to any shot of replenishment due to this command signal, a replenishment shot appropriate to the width of paper 10 will be initiated within one second of the time that any sheet or strand of paper 10 is introduced into an otherwise vacant input slot. This assures that all single sheets of paper 10 will be sensed and accounted for with suitable replenishment.

The room light is normally off at the processor's 11 input slot; but if the room light is on, all transistor 100 are continuously illuminated; there is a continuous input through resistors 106 to summing amplifier 134; and transistor 140 is continuously biased on. Also, since capacitor 142 is not permitted to charge, transistor 136 cannot be triggered. If, however, the room light is switched off, then on, so that the general illumination goes from dark to light after all transistors 108 have been reset by being dropped out of conduction by the negative-going command pulse from timing circuit 322, one, and only one full-width shot of replenishment will result. To prevent this latter occurrence, the sensitive, low resistance, cadmium sulphide photocell 452 is connected into two end slots of connector 306 to be in contact with conductors 364 and 312. This sinks the bias current of transistor 168 supplied through resistor 180 and makes the replenishment system unresponsive to general illumination under any condition. Thus, the utilization of the set of latched PNPN device means, such as the unijunction transistor 108 or any semi-conductor triode means, to supply input current segments to the summing circuit means 28 in combination with the photocell 452 is unique.

Principle functions and special characteristics of the various components (i.e. resistors, capacitors and diodes) which weren't specifically mentioned in the explanation of the circuitry operation of the invention, hereinbefore set forth, will be stated. Capacitors 176 and 354 are timing capacitors and the former, for 50 inches processors, includes a leakage less than about 0.4 uA (microampere). Capacitor 462 is a transient pulse suppressor, and capacitor 470 suppresses incoming EMI. Capacitor 456 (preferably ceramic disc type) improves stability and reduces response to transients, whereas capacitors 372 and 374 store energy for brief high-current pulses. Capacitor 386 reduces noise superimposed on the pulse. Capacitor 390 provides energy storage and filtering for the −15 v portion of the power supply circuitry. Capacitor 446 has a principle function of switching-transient suppression and must be characterized for operation at 120 v RMS. Capacitor 384 improves voltage regulator's 550 stability and preferably has a small value because larger values degrade pulse response. Capacitor 338 is a stabilizer for timing circuit 322 and is preferably a low self inductance ceramic disc. Capacitor 490 filters pulse spike from +15 v to improve time accuracy, and capacitor 336 has a principle function of being a replenishment command interval timer and is preferably metalized polycarbonate or equal for long term stability. Resistor 166 limits peak input surge to protect integrator amplifier 156. Its value may be +20% of the preferred value. Resistor 174 controls discharge rate of capacitor 176 and must be much lower resistance than resistor 164 but greater than 9 K. Resistor 152 controls the rate of rise of current into comparator amplifier 148 and has a value equal to resistor 154 which is preferably 10 K ± 1%. This value could optionally be lowered for smaller processors rather than reducing resistor 162 and resistor 164, but this would make capacitor's 176 leakage more critical. Resistor 182 preferably sets current through relay 36 to about 7.5 mA (nominal), and resistor 348 sets the charging rate for capacitor 354. Resistor 346 in conjunction with resistor 558 programs the trip point and valley current of transistor 350. Resistor 366 limits the maximum instantaneous current from capacitor 354 through transistor 350. Resistor 154 has the principal function of setting the reference current, and resistor 138 sets the minimum input to which the replenishment relay 36 will respond. Resistor 492 charges capacitor 142 preparatorily to triggering thyristor 136. Resistor 164 sets the minimum limit on replenishment time per segment adjustment resistor 162, and resistor 358 sets width of current pulse to infrared LED's, diodes 104. The latter resistor has the special characteristic of being a miniature trimmer and must withstand 0.5 A peak for less than 10 m sec. which would be the worst case. Resistor 472 is a bias resistor for thyristor 136 and limits the range of trigger circuit energy requirements for the capacitor 142, thyristor 136 combination. All units in a preferred embodiment should readily trigger from capacitor 142 which is preferably equal to 0.05 mfd. Resistor 188 forms a filter circuit with capacitor 470 and resistor 190 to make brief transients ineffective. Resistor 396 is a partial divider for the voltage regulated sensing circuit 24; resistor 400 is also a partial divider. Resistor 398 in combination with resistors 396 and 400 set the pulse height to about 15 v. Resistors 310 and 484 are multiplier resistors for paper width meters 34. Resistor 324 sets a negative going reset pulse duration (i. e. 0.023 sec), and resistor 368 limits the current through diode 370. Resistors 378 and 180 are bias resistors for transistors 376 and 168, respectively. Resistors 394 and 438 are current limiting for −15 v and +15v, respectively, zener regulated voltage. Resistors 362 and 190 are respectively base bias resistors for transistor 380 and transistor 140. Resistor 448 is current limiting in the arc suppression circuit and its value is selected to optimize relay contact protection when switching the inductive load presented by the solenoid coil. Diode 480 limits negative excursion at output of integrator amplifier 156 to about 0.5 volts. Its type is preferably IN914. Zener diode 172 isolates the input end of integrator-amplifier 156 from a test point on conductor 170 at the junction point with collector electrode of transistor 168 when the same is low. Diode 182 has the principle function introducing a voltage offset thus allowing photocell 452 to sink transistor's 168 bias to essentially zero. Diode 442 is a transient suppressor. Diodes 392 and 488 are respectively negative and positive zener regulators (15v ±1% at 20 mA). Diode 178 isolates the output of comparator amplifier 148 from base electrode of transistor 168 when the output is +12 v. Diode 478 limits the negative excursion at the output of comparator amplifier 156 to about 0.5v. Diode 370 is a visible light emitting diode and in the absence of other indication serves to show that transistor 350, voltage regulator 550, and transistor 376 are supplying energy pulses to diodes 104. Diodes 404, 406, 408 and 410 are power rectifiers rated at least 0.5 A, 50 PRV. Diode 466 protects capacitor 462 and limits positive excursion at output of summing amplifier 134. Diode 370 is a visible "blink" signal (non-critical LED).

Figure 2:
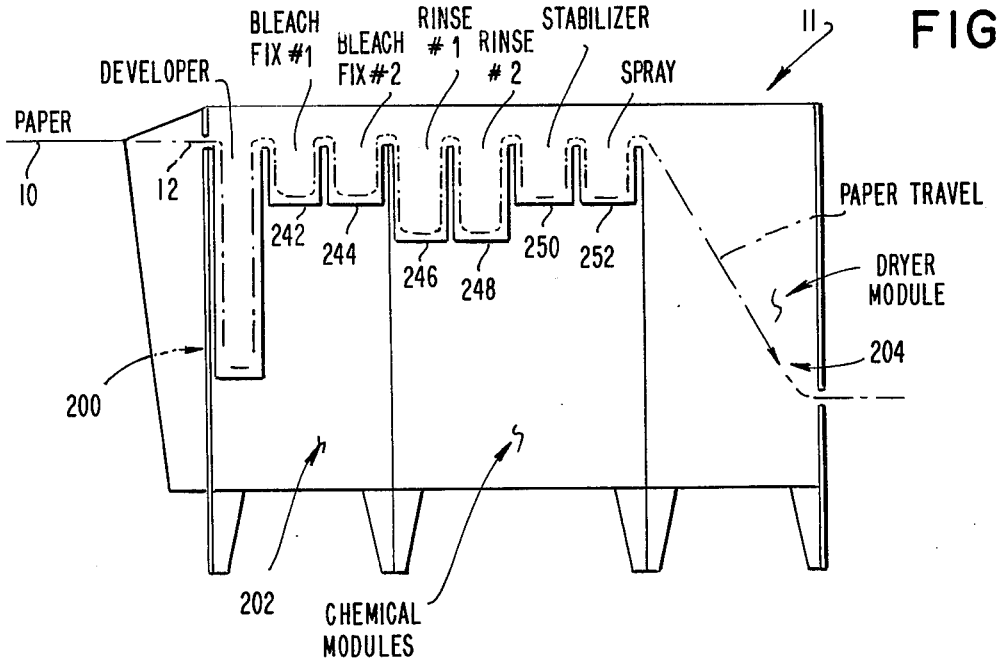
FIG. 2 is a side elevational view of a processor with the path of film travel illustrated in dashed lines.

While the electrical circuitry of FIG. 5 is causing replenishment of chemicals in accordance with FIG. 4, all of the sets of rollers 274 in the processor 11 are driven by a positive drive at a constant speed. This includes the smooth surfaced companion rollers 278 and 280. The film strips or sheets 10 are introduced into the processor 11 with the emulsion side of the film facing the stocking roller 276. An initial means for advancing and guiding the film 10 to the first set of rollers 274 is schematically shown in FIGS. 2–3. As the film 10 comes between rollers 278 and 276, the fibrous covering is caused to partially compress against the emulsion surface, thereby effecting a scrubbing action by the displaced fibers. This action not only agitates the exhausted chemicals on the emulsion, but also entraps these chemicals in the stocking 282, carrying it through the area of contact with the film 10 and the companion roller 278. As the film 10 travels from the first to the second set of rollers, it is exposed to a flow of fresh chemical solutions flowing from slots 298 around the edge 300 of the distribution chamber as indicated by the arrows in FIG. 6. When the film 10 passes between the bottom set of rollers 278 and 276, it is guided by some form of guide 302 back up the opposite side of the stocking rollers 276 in contact with companion rollers 280. While not illustrated in the drawing, the stocking covering could be on the companion rollers 278 and 280 with the center roller 276 smooth surfaced. With this configuration, the emulsion side of the film would be reversed. The stocking can also be used on both center roller and companion rollers.

The flow of fresh solution flowing through slots 298 contacts and passes through the stocking material 282 washing out the exhausted chemicals collected from the emulsion. When there is no film passing through the rollers, flow of fresh solution against the stocking and the compression of the stocking by its companion rollers causes the stocking roller to thoroughly clean and rinse itself. Also, the action of the scrubbing fibers on the companion rollers 278 and 280 keeps them free of any build up.

While the present invention has been described herein with reference to particular embodiments thereof, a latitude of modifiction, various changes and substitutions are intended in the foregoing disclosure, and in some instances some features of the invention will be employed without a corresponding use of other features without departing from the scope of the invention as set forth.

We claim:

1. An infrared sensed chemical replenishing system for a photosensitive material processor, the system comprising:

a power supply;

a pulsed infrared sensing means including;

emitter means having an infrared emitting diode, said sensing means electrically connected to said power supply for measuring the width of photosensitive materials without touching the same, said sensing means having an infrared-sensitive photo transistor, an anode resistor, a gate resistor, and a programmable unijunction transistor having its gate electrode attached between said gate resistor and said photo transistor, said anode resistor being in series with said unijunction transistor and said gate resistor being electrically connected with said photo transistor;

pulse generator circuit means electrically attached to said emitter means for generating a pulse width and repetition rate;

summing circuit means electrically connected to said sensing means for producing a summation of all latched input elements transmitted from said sensing means;

replenishment calibration timing circuit means electrically attached to said sensing means and said summing circuit means for producing at least one replenishment command signal following at least one successive time interval, said time interval being equal to the time required to turn a processor drive used in driving the processor one revolution; and control circuitry means electrically connected with said summing circuit means and said timing circuit means for controlling the chemical flow of the replenishment system.

2. The infrared sensed chemical replenishing system of claim 1 wherein said emitting diode additionally includes a first resistor in series therewith.

3. The infrared sensed chemical replenishing system of claim 1 wherein said sensing means comprises a photo switch transistor, a gate resistor in series with the gate electrode of said switch transistor, and an anode resistor in series with the anode electrode of said switch transistor.

4. The infrared sensed chemical replenishing system of claim 1 wherein said generator circuit means comprises a voltage regulator module, a sampling interval timer means in electrical communication with said regulator module, an enabling switch transistor in electrical communication with said timer means and said regulator, a power transistor in electrical communication with said regulator, and a maintaining bias resistor in electrical communication with said switch transistor to keep said regulator normally off.

5. The infrared sensed chemical replenishing system of claim 4 wherein said sampling interval timer means comprises an oscillator transistor, a second resistor and a third resistor in electrical series with each other, said oscillator transistor having its gate electrode electrically connecting between said second and said third resistor, a fourth resistor in series electrically with said anode electrode of said oscillator transistor, a timing capacitor attaching between said fourth resistor and said oscillator transistor, and a fifth resistor in series electrically with the cathode electrode of said oscillator.

6. The infrared sensed chemical replenishing system of claim 5 additionally including a sixth resistor in series electrically with the base electrode of said enabling switch transistor and electrically connecting between said oscillator transistor and said fifth resistor, a seventh resistor in series electrically with said fifth resistor and in electrical communication with the emitter electrode of said switch transistor, a plurality of pulse height setting resistors in series electrically with each other and in electrical communication with said enabling switch transistor, said power transistor additionally including a second bias resistor, at least one energy storage capacitor in electrical communication with the collector electrode of said power transistor, a step down transformer in electrical communication with said regulator, and a plurality of power diode rectifiers in electrical communication with said regulator.

7. The infrared sensed chemical replenishing system of claim 1 additionally including a reset timing means in electrical communication with said sensing means and said generator circuit means.

8. The infrared sensed chemical replenishing system of claim 7 wherein said reset timing means comprises a reset timing module, a first resistor for setting the interval between replenishments command, a second resistor for reset pulse duration, a first capacitor for replenishment command interval timing, said first resistor, said second resistor and said first capacitor each being in electrical communication with said reset timing module.

9. The infrared sensed chemical replenishing system of claim 7 wherein said summing circuit means comprises a summing amplifier, a summing feed back circuitry means in electrical communication with said summing amplifier, a first resistor for setting the minimum input to which a replenishment relay will respond, said first resistor being in electrical communication with said summing amplifier.

10. The infrared sensed chemical replenishing system of claim 9 wherein said feed back circuitry comprises a second resistor, a third resistor in series electrically with said second resistor, said second resistor and said third resistor in combination set the output level of said summing amplifier at a predetermined voltage when all of said input elements are active.

11. The infrared sensed chemical replenishing system of claim 9 wherein said control circuitry means comprises a start circuitry which responds to the sum of all latched input elements from said summing circuit and closes a relay and starts said replenishment calibration timing circuit means, and a stop circuitry means which compares the sum of all latched input elements from said summing circuit and the calibrated time integral from said replenishment calibration timer means and when the output from said calibration timer circuitry becomes slightly greater than the output from said summing circuit, stop circuitry opens said relay to close a solenoid valve and to subsequently reset the output of said replenishment calibration timer circuitry to zero.

12. The infrared sensed chemical replenishing system of claim 11 wherein said start circuit comprises a gating switch transistor, an energy storing capacitor in electrical communication with said gating switch transistor, a relay circuitry thyristor for completing the circuitry to said relay, said relay thyristor being in electrical communication with said energy capacitor, and a bias resistor for said relay thyristor to limit the range of trigger circuit energy requirement for said energy capacitor and said switch transistor combination.

13. The infrared sensed chemical replenishing system of claim 12 wherein said stop circuit comprises a switching transistor in electrical communication with said relay thyristor and said relay for opening the relay circuit, and a comparator amplifier in electrical communication with said switching transistor.

14. The infrared sensed chemical replenishing system of claim 13 wherein said replenishment calibration circuit means comprises a calibration control means, a calibration timer amplifier in electrical communication with said calibration control menas, and a timing capacitor in electrical communication with said calibration timer amplifier.

15. The infrared sensed chemical replenishing system of claim 14 wherein said calibration control means comprises a plurality of calibration resistors, said calibration resistors being in electrical communication with said gating switch transistor.

16. The infrared sensed chemical replenishing system of claim 15 wherein said stop circuit and said start circuit are each in electrical communication with a shut-down photocell to inhibit the relay circuit when room lights are on.

* * * * *

UNITED STATES PATENT AND TRADEMARK OFFICE

CERTIFICATE OF CORRECTION

PATENT NO. : 4,021,832

DATED : May 3, 1977

INVENTOR(S) : Vivian D. Krehbiel and Carl E. Cord

It is certified that error appears in the above-identified patent and that said Letters Patent are hereby corrected as shown below:

Abstract, line 1, after "A" insert --- method and a ---;

Column 2, line 48, delete "processor" , second occurrence, and insert therefore -- process --;

Column 8, line 51, delete "32" and insert therefore ---322---;

Column 11, line 3, delete "trnsistor" and insert therefore --- transistor ---;

Column 12, line 54, after "VA." insert --- C. ---;

line 58, after "398" delete --- are ---;

Column 14, line 53, after "red" insert --- ) ---;

Column 16, line 14, after "point" delete "or" and insert therefore --- on ---;

Claim 14, column 22, line 37, delete "menas" and insert

UNITED STATES PATENT OFFICE

CERTIFICATE OF CORRECTION

Patent No. 4,021,832 Dated May 3, 1977

Inventor(s) Vivian D. Krehbiel and Carl E. Cord

It is certified that error appears in the above-identified patent and that said Letters Patent are hereby corrected as shown below:

-- means --.

Signed and Sealed this ninth Day of August 1977

[SEAL]

Attest:

RUTH C. MASON
*Attesting Officer*

C. MARSHALL DANN
*Commissioner of Patents and Trademarks*